United States Patent [19]

Perry

[11] 3,989,911

[45] Nov. 2, 1976

[54] MAGNETIC DIFFERENTIAL PRESSURE SWITCH

[76] Inventor: Joseph A. Perry, 1815 Eleanor Ave., St. Paul, Minn. 55116

[22] Filed: Sept. 5, 1975

[21] Appl. No.: 610,523

[52] U.S. Cl. ..... 200/83 L; 73/406

[51] Int. Cl.[2] ..... H01H 35/34

[58] Field of Search ..... 73/406; 335/205, 206; 200/83 R, 83 A, 83 L, 81.9 M, 84 C; 92/99

[56] References Cited

UNITED STATES PATENTS

| | | | |
|---|---|---|---|
| 3,285,183 | 11/1966 | Hembree | 200/83 L |
| 3,551,620 | 12/1970 | Hoover | 200/83 L |

FOREIGN PATENTS OR APPLICATIONS

| | | | |
|---|---|---|---|
| 2,021,984 | 11/1970 | Germany | 200/83 L |

*Primary Examiner*—Gerald P. Tolin

*Attorney, Agent, or Firm*—Schroeder Siegfried Ryan & Vidas

[57] ABSTRACT

A differential pressure switch incorporating a differential pressure sensor formed by a body having shaped chambers therein and an elastic diaphram moving a shaft mounting a magnet and coupled magnetically to magnetically operate controllers mounted outside of the body and adjustably positioned relative to the shaft and magnet for a wide range of adjustment.

14 Claims, 5 Drawing Figures

MAGNETIC DIFFERENTIAL PRESSURE SWITCH

My invention relates to a differential pressure switch and more particularly to an improved differential pressure switch capable of detecting when two hydrostatic pressures are equal and operable to trip either an electrical or fluid circuit in response to this condition.

Pressure switches and in particular differential pressure switches are well known and take a variety of forms. It is also recognized that it is far easier to detect a positive differential pressure then a zero differential pressure in the operation of a switch. This is particularly true because the forces available for actuation at zero differential pressure are zero themselves. Where the switch or controller is operated through a linkage from the pressure sensor, the forces of friction play an important part and effect the accuracy of zero differential pressure are zero themselves. Where the switch or controller is operated through a linkage from the pressure sensor, the forces of friction play an important part and effect the accuracy of zero differential pressure detection. The forces of friction are normally constant throughout the entire range of operation of the device while the forces of actuation decrease as the differential pressure approaches zero. Thus, in prior switch designs, the pressure differential sensor is normally a diaphram which experiences frictional forces applied thereto and often requires complex balancing mechanism to effect accuracy of the switching or controlling operation at zero differential pressure.

In the present invention an improved differential pressure sensor is provided in which a diaphram senses the differential pressure and raises or lowers a sealed magnet structure to operate switches through the wall of the sealing mechanism so that frictional forces are not involved or are extremely minimal. The controllers or switches are adjustably positioned outside of the pressure sensor and are coupled magnetically with the pressure sensor for operation so that an accurate adjustment of the switch operating position may be affected without varying the forces applied on the pressure sensor or diaphram. The improved differential pressure sensor of the present invention also provides a simplified arrangement by means of which a secondary or additional controller may be adjustably positioned to operate as the balance or zero differential pressure is approached as an advanced warning of the same or as an additional control where the differential pressure switch is used on an on/off device. Similarly, the plurality of such switches may be positioned around the magnet system for sequential operation above and below the zero differential pressure point for electric or fluidic control of a process so that an accurate adjustment of the zero differential pressure point is obtained. Thus, in the present invention, an improved pressure differential switch is provided with a differential pressure sensor formed by a diaphram defining a pair of pressure chambers therein. One of the chambers has associated therewith a shaft bearing against the diaphram and carrying a magnet, the shaft and magnet being sealed to the body of the pressure sensor and transmitting magnetic flux from the magnet to a magnetically operated controller such as a switch, for operation of the same in accord with variation and position of the pressure sensor or diaphram. By adjusting the shape of the cavity in which the diaphram is displaced, the linearity of the sensor movement with respect to pressure differential sensed may be varied and through adjustment of position of the controllers associated with the magnets, a partial and full shut off control may be obtained as the zero differential pressure point is approached and reached. A plurality of switches may be utilized to sense this function from either side of the reference point by responding to a change in the direction of differential pressure. This provides a device having a narrow range of operation at the zero differential pressure point and which is extremely sensitive within this range while being generally insensative to pressure differentials outside of the operating range even though they may be of great magnitude. The improved differential pressure switch utilizes a free and unrestrained elastic diaphram requiring no springs, links, levers, bearings or shaft seals and consequently is one in which the frictional forces are minimal or insignificant.

It is therefore an object of this invention to provide an improved differential pressure switch.

Another object of this invention is to provide in an improved differential switch a coupling arrangement between the pressure sensor and the magnetically operated controllers or switches to eliminate the effect of frictional forces on the diaphram or pressure sensor.

A still further object of this invention is to provide a pressure differential switch which is sensitive to minute changes in pressure.

Another object of this invention is to provide an improved differential switch utilizing a diaphram within a pair of variable sloped chambers to increase and accentuate the natural non-linearity of the diaphram motion versus differential pressure and to increase the working range of the device.

A still further object of this invention is to provide an improved differential pressure switch which requires no springs, links, levers, bearings, or shaft seals for operation of the switch.

A still further object of this invention is to provide an improved differential pressure switch in which the control point of the switch is variable and adjustable.

These and other objects of the invention will become apparent from the reading of the attached description together with the drawings wherein.

Figure 1:
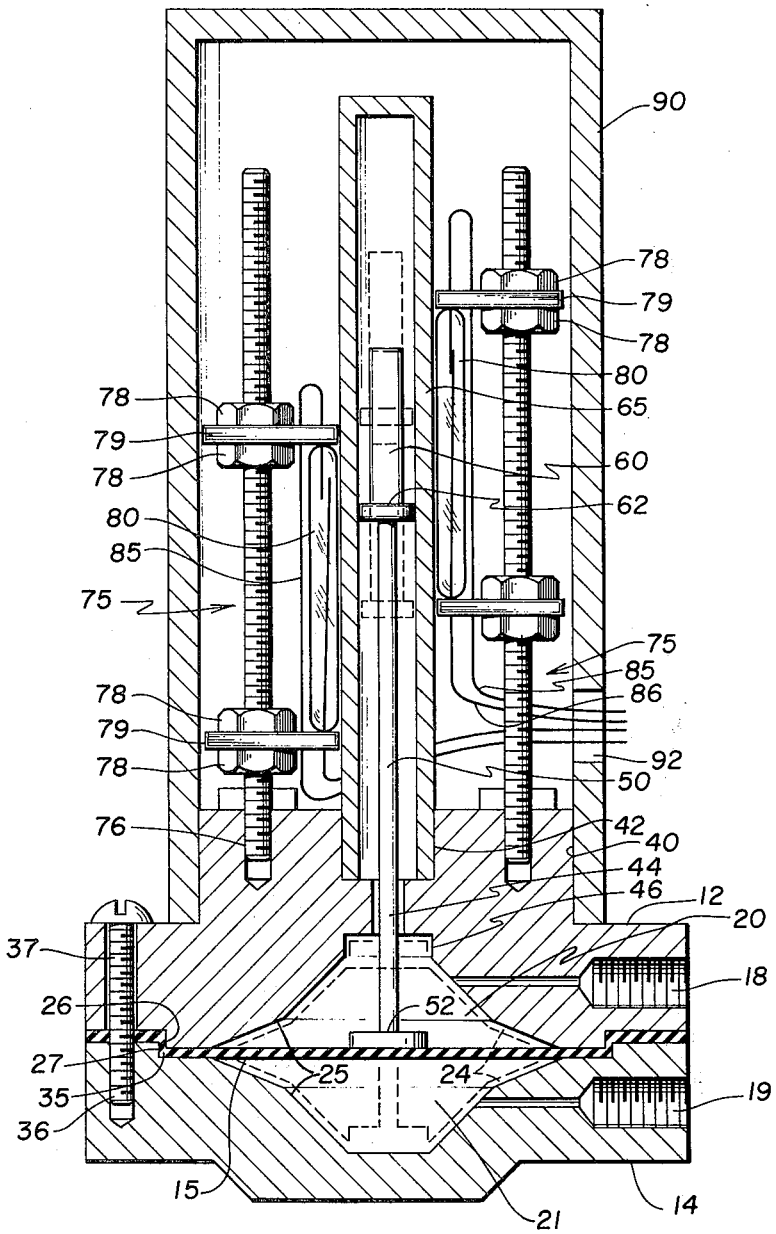
FIG. 1 is a vertical section taken through the pressure differential switch.
Figure 3:
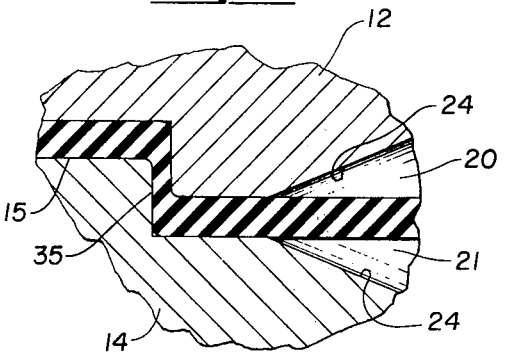
FIG. 3 is a fragmentary sectional view of the diaphram of the pressure sensor.
Figure 4:
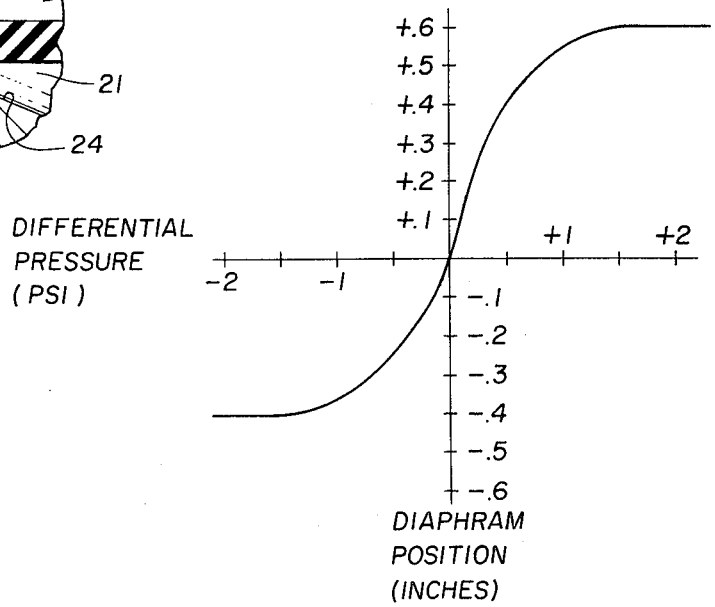
FIG. 4 is a schematic diagram of diaphram movement versus pressure differential applied to the pressure sensor of the switch; and, FIG. 5 is a schematic diagram of the application of the improved differential pressure switch.

My improved differential pressure switch is shown in FIG. 1 in a sectional view to show the components of the same. Thus, in FIG. 1, the pressure differential switch 10 is comprised of a pressure differential sensor formed of body parts 12 and 14 having a diaphram 15 positioned therein and with ports 18 and 19 leading to the interior of the body which is separated into chambers, to be hereinafter identified. The pressure sensing body formed of parts 12 and 14 preferably made of metal and are cylindrical in form having the same circumferential dimension and with a sloped recess 20 and 21, respectively positioned therein and with the ports 18 and 19 terminating in the recesses. As will be seen in FIG. 1, each recess has an initial slope from the outer periphery as one angular dimension, such as is indicated by the surface 24, with a steeper slope as indicated by the surface 25 and with each recess being generally symmetrical in form. The body parts each have a shoulder portions 26, 27 respectively which will be later noted to serve to aid in clamping the diaphram 15 therebetween. The diaphram 15 is a cylindrical member of elastic material which in the normal or referenced position equally divides the recesses and provides for the separate chambers 20, 21 communicating respectively with the ports 18 and 19. The diaphram 15 is connected between the shoulder portions 26, 27 which are of different diametrical dimension and with the spacing therebetween slightly smaller than the normal thickness of the diaphram, as indicated in FIG. 3, such that the diaphram 15 is squeezed between the shoulder portions to have a lesser thickness than the normal diaphram thickness as indicated at 35 in FIG. 3. The diaphram should be capable of large deformations and yet will return to its original shape and when the diaphram is wedged or squeezed in a vertical plane as shown in FIG. 3 between the shoulder portions 26, 27 of the body parts 12 and 14, the clamping arrangement results which provides an extremely tight and leak-proof gasket seal and which restrains the diaphram during assembly of the body parts 12, 14 causing a tensioning or drum head effect so that the surface is stretched and taunt. The diaphram is secured between the body parts by means of bolts 31 which thread into tapped apertures 36 in the body part 14 to clamp the body parts together and the diaphram therebetween. With this arrangement, the diaphram is extremely sensitive to minute changes in pressure, for example, 0.05 psi may provide a diaphram movement up to ⅛ inch. Similarly, the diaphram in dividing the separate recesses to define the chambers of the pressure, sensor is capable of following the contour of each recess which has increasing slope in the direction away from the reference or neutral position in which the diaphram equally defines the chambers. This slope increased and accentuates the natural nonlinearity of the diaphram motion versus pressure differential as will be seen in FIG. 4. In this manner, the working range of the pressure sensor is increased and a wide latitude in setting the point of switch operation is provided.

The body part 12 has an annular or raised shoulder portion 40 which will be later noted, serves to mount a cover and the mounting members for the switches to be later identified. The shoulder portion 40 has a circular recess 42 therein communicating with a passage 44 extending into the chamber above the diaphram with the passage having a shoulder 46 adjacent the steeped sloped surfaces 25. A shaft 50 having a flat head member 52 at one extremity of the same and positioned within the recess in the body part 12 above the diaphram 15 rests against the diaphram with the shaft extending through the passage 44 and out of the body part 12. The opposite end of the shaft mounts a magnet 60 above the guide end 62 on the shaft with a closed tubular member 65 of the non-magnetic material being fitted over the shaft and the magnet and into the recess 42 to be sealed therein. The tubular member 65 is closed at the upper extremity and mounts and guides the magnet on the end of the shaft for sliding movement therein. It may be made of a glass or plastic material or a non-magnetic material.

Mounted on the annular shoulder portion 40 of body part 12 are a plurality of switch mounting members indicated generally at 75, which mounting members are rod-like threaded members fitting down into tapped apertures 76 in the shoulder portion 40. These rod-like members extend parallel to the tubular member 65 and are threaded along their extent. As will be later noted and depending upon the configuration of the switch, two or four mounting members may be employed, the mounting members being generally positioned in diametric relationship with respect to the tubular member and the shaft. Each rod-like member 75 mounts a plurality of nuts 78 with pairs of nuts mounting a flat switch mounting flange 79 between. Two such switch mounting flange members 79 are located on each shaft with the nuts 78 on either side of the same to adjust the position of the mounting member on the rod and relative to the tubular member 60 with a magnet therein.

In the embodiment shown herein, the switch members are magnetically operated reed switches 80 which are positioned at different heights above the body part 12 and along the extent of the tubular member 65 to be influenced by the magnet 60 carried by the end of the rod. Although reed switches are shown, other type of magnetic switching controllers may be utilized, such as fluidic controllers with a magnetic circuit therein operated with the magnet 60 as the magnet moves past the same and to be influenced by the field of the magnet. As shown in FIG. 1, the reed switches have electrical conductors 85, 86 extending from the ends of the respective same with the reed switches being mounted between the flange-like mounting member 79 on the rod-like members 65 to be held in position adjacent or near adjacent relationship with the tubular member 65. A cover 90 is positioned over the magnetically operated switches fitting on the shoulder 40 of the body part 12 to encircle the same with an aperture 92 being positioned therein to permit the connection of the lead wires to the switches. The upper and lower chambers formed in the body parts 12 and 14 on either side of the diaphram 15 are sealed except for the ports 18 and 19 communicating respectively therewith. In the operation of the pressure differential switch, a fixed pressure is applied to one of the chambers and a variable pressure to the other to displace the diaphram in one direction or the other depending upon the relationship of the variable pressure with the fixed pressure. Thus, whenever the pressure below the diaphram exceeds the pressure above the diaphram, the diaphram is displaced upwardly raising the shaft 50 through the headed portion 52 bearing against the diaphram 15 with the diaphram following the contour of the upper recess or the recess in the body part 12. The variation in slope permits a wide range in pressure diffential to occur raising the magnet within the tube and relative with the switches for operation of the same. As will be seen in FIG. 1, a pressure differential in which the pressure at the upper chamber significantly exceeds that of the lower chamber will cause the elastic diaphram to follow the contour of the lower recess dropping the magnet down to a lower position to influence the lowest actuated switch. In the reference position, the switch mounting members are adjusted so that the magnet is positioned relatively between the two switches so as not to influence either reed switch or magnetically operated controller. Variation of the magnet position due to diaphram movement in one direction or the other will thus effect a change in the operation of one or the other of the switches, depending upon the direction of movement of the magnet to close the same. Thus, the differential pressure switch in the reference position will operate as a shut-off device or open circuit on the respective controllers on the configuration shown.

Figure 2:
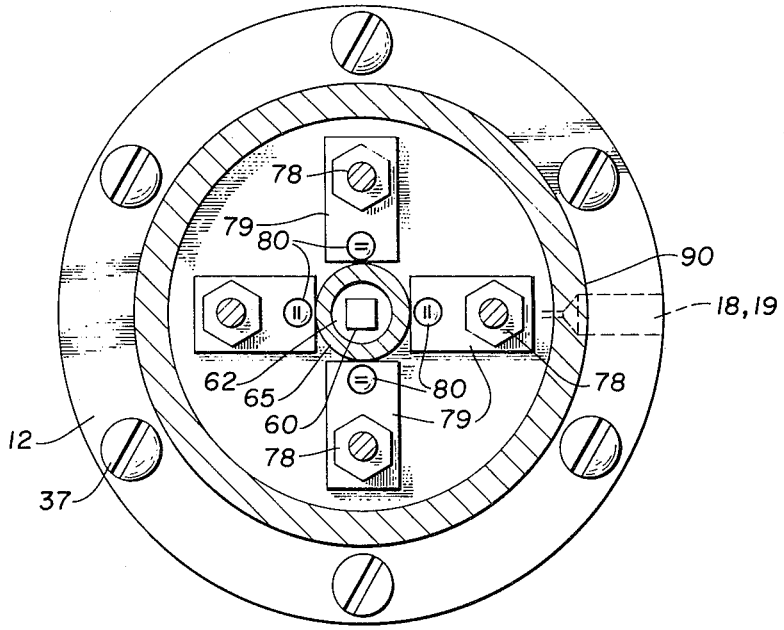
FIG. 2 is a horizontal sectional of the differential switch of FIG. 1 showing a modification of the switching arrangement.

In the embodiment of FIG. 2, four such switches are mounted on the body part 12 through mounting member using the same mounting configurations as shown in FIG. 1. The mounting flanges position the reed switch or magnetic controller about the periphery of the tubular member to be influenced by the magnet as it moves up or down from the reference position in which the diaphram equally divides the chambers in the body part. For convenience, these switches are positioned in diametrically opposed relationship and, as will be later noted, two such switches will be located above the reference point and two below the reference point with each of the pairs of switches being slightly separated so that one will operate before the other to provide a variation in the control function.

The differential pressure switch shown herein utilizes an elastic diaphram which readily displaces to conform to the shape of the recess moving the shaft with a magnet thereon up and down within the tubular member to influence the operation of the switches associated therewith. The elastic member has a memory to return to the reference position when the pressure differential reaches a zero pressure. The forces of friction are minimal since the shaft is merely guided in the tubular member by the collar 62. In a typical application of the differential pressure switch, the fixed pressure being applied, for example, to port 18 above the diaphram may represent a desired quantity or reference point. The variable pressure applied below the diaphram through port 19 may represent the variable to be introduced into a system until a desired amount indicated by the reference pressure at port 18 is obtained. The diaphram 15 being very elastic collapses with the increased pressure above the diaphram and conforms to the shape of the chamber or recess in the body part 14. The magnet rod 50 is of relatively light weight construction and by the force of gravity, follows the motion of the diaphram 15. The magnet rod then follows the diaphram down to the lowermost position. At this point, the magnet 60 will be adjacent the lowermost switch 80 and the switch will be closed. This switch can control, for example, a pump or a valve adapted to fill a particular vessel with the variable pressure being applied to port 19 following the level of the vessel being filled and changing in accord with the level due to the pumping or flow. When the pressure in the ports 18 and 19 reach an equal relationship or zero differential pressure, the diaphram will have reached the neutral point and the magnet rod 60 will have elevated the magnet 60 above the lower switch 80 to open the same, stopping the operation or the pump or closing valve.

The opposite switch or the one above the reference point may be used for the same operation with the reference and variable pressures reversed. Thus, the application of the differential pressure switch may dictate the use of one or more switches or controller relative to the tube in the operation of a particular system. A pair of switches are shown in FIG. 1 for simplicity, but a single switch may be all that is required for a particular switching function.

A throttle or dribble action can be obtained by using a second switch below the reference point, such as suggested by the four switches shown in FIG. 2. Thus, two switches are above and two switches below the reference point with one being slightly below the other in a relationship of pairs with respect to the reference point. Thus, one switch will open prior to the other below the reference point and such switching operation may be used for partially opening or closing a valve or reducing a flow rate of pump to anticipate the shut-off of the second switch. This dribble action may provide a quiencent condition at the time of cutoff due to overshoot because of the inability of the flow control device to stop immediately due to inherent times lags when signaled.

Figure 5:
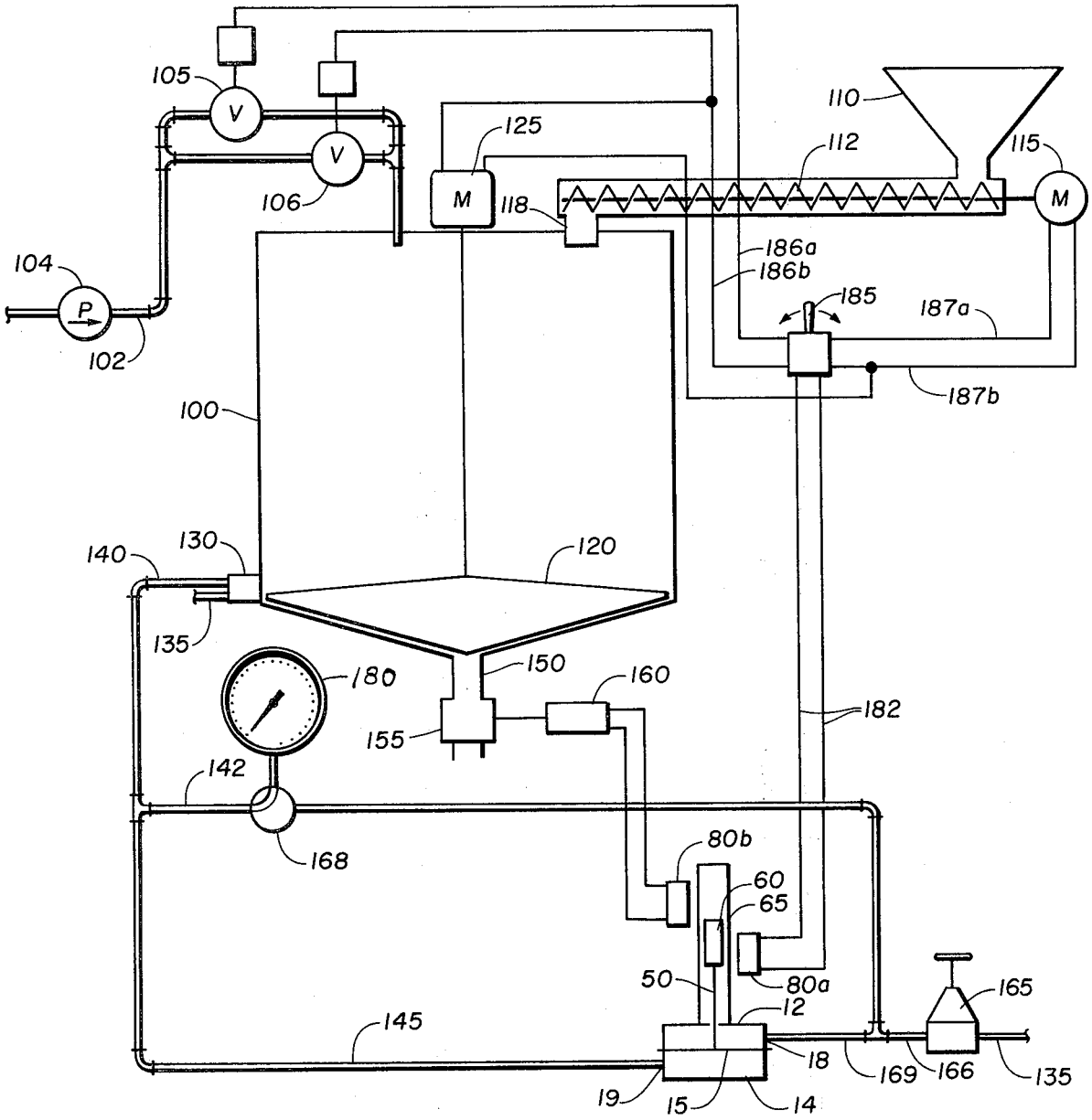

A typical batch system or application for the differential pressure switch is shown in FIG. 5. As an application of the switch of FIG. 2, it includes a container 100 which is adapted to have a liquid and the dry material blended together therein in a desired quantity. The line 102 leading from the pump 104 and through a pair of valves 105 and 106 controls the introduction of a liquid into the container. Similarly, a dry material to be blended with the liquid fed from a hopper 110 to an auger 112, and the auger being driven by a two speed motor 115 and discharging the dry material into the container through a port 118. An agitator blade 120 driven by a motor 125 is positioned in the container and blends the materials being batched, its operation being controlled through switching from the magnetic controllers. The base of the container has positioned therein a pressure transducer 130 which is similar or may be that shown in my U.S. Pat. No. 3,845,664, this pressure transducer being supplied from an air source 135 to provide an air signal output 140 in accord with the amount of material in the container. The base of the container has an outlet port 150 having a suitable control valve 155 controlled by a two position actuator 160. In this schematic disclosure, the air source 135 is also fed through a precision pressure regulator 165 which leads to a pipe conduit or outlet 166 leading to a selector valve 168 coupled to an indicating gauge 180. The outlet side of the pressure regulator valve is also fed to the pressure differential switch 10 through a conduit 169. The pressure transducer air signal indicative of the amount of material positioned in the container is fed through a conduit 142 to the selector valve 168 and the gauge 180 and and through a piping 145 to the other side of the differential pressure switch 10. As described above, the pressure differential switch contains its operating magnet 60 coupled through the shaft 50 and bearing against the diaphram 15 to follow the movements of the diaphram. For simplicity, the magnetically operated controllers or switches are shown in block at 80a below the normal position of the magnet and 80b above the normal position of the magnet for filling and discharging of the container, as will be hereinafter identified. It will be recognized that for the purpose of this discussion, four such switches, or controllers, are located around the tubular member surrounding the magnet shaft, two above and two below the reference points with each of the pairs of switches above and below being separated slightly to provide a throttling or dribble control which will be hereinafter identified. The output of the pair of switches **80*a* are connected by the cabling 182 to a three way switch 185, the switch having a pair of output conductors 186*a* and 186*b* leading respectively to the valves or the actuator of the valves 105, 106 with the second pair of output conductors 187*a* and 187*b* leading to the two speed motor 115 driving the auger. The output conductors 186***b* and 187*b* are also connected to the agitator motor or controller therefore to switch on the agitator whenever the switches controlling main flow are closed and to shut off the agitator whenever the switches controlling only dribble action are operating.

Whenever it is desired to prepare and blend a batch of material, the selector valve 168 is shifted to couple the conduit 166 with the pressure regulating valve 165, such that a desired pressure setting may be selected at the pressure regulator and indicated on the gauge 180 to indicate a desired volume of an ingredient to be introduced into the container at the start of the batch making process. For example, if 6000 lbs. of liquid is to be introduced into the container, the pressure regulating valve will be adjusted to provide a pressure signal output which will indicate on the meter the desired 6000 lb. weight. With the pressure regulating valve so adjusted, a pressure will be applied to the upper chamber of the differential pressure switch. The opposite side of the differential pressure switch which is connected to the pressure tranducer 130 will have a pressure signal indicative of zero or no quantity in the container and this pressure will be applied to the lower chamber of the differential pressure switch below the diaphram 15. The selector valve 168 would be then changed to sense this pressure, indicating the quantity of material in the container at this time, which would be zero. The pump would then be started with the selector switch 185 connecting the cabling 182 to the conductors 186*a* and 186*b* leading to the motor operated valves 105, 106. With the larger pressure above the diaphram, the differential pressure switch would have the magnet moved lower or below the reference position due to deflection of the diaphram into the lower recess and closing both of the switches 80*a* below the reference point on the switch transducer. This would cause both of the valves to be open and with the operation of the pump and the agitator to run. Liquid would then be introduced into the container. As the liquid is introduced into the container, the pressure transducer will sense the weight of the material in the container which will be reflected by change in pressure to the differential pressure switch increasing the variable pressure below the diaphram of the differential pressure switch. This change in pressure would also be indicated on the gauge 180. As the desired quantity, for example 6000 lbs. was approached, the lowest of the switches 80*a* would first be operated to an open position causing the dribble valve 106 to shift to a throttle position, reducing the flow into the container and the agitator to turn off. When the weight in the container reaches the desired weight as set by the pressure regulator 165, the pressures on either side of the diaphram will approach zero differential pressure at which point the second of the switches 80*a* will open causing complete closing of the conduit by operation of the shut-off valve 105. With the 6000 lbs. of liquid material in the container, the dry ingredient is then ready to be introduced.

The switch 185 is moved to couple the magnetically operated controller switches 80*a* through the cabling 180 to the conductors 187*a* and 187*b* leading to the dual windings of the drive motor 115 of the auger. With this change and with the pump 110 shut off, the selector valve 168 is changed to couple the air line to the pressure regulating valve 165 and a new setting for the pressure regulating valve 165 is obtained. This will be dictated by the desired quantity of the material to be introduced into the container to be mixed in the batch. Thus, for example, if 4000 lbs. of a dry ingredient is to be introduced, the total quantity in the container would be 10,000 lbs. and consequently, the pressure regulating valve 165 would be adjusted to provide a fixed air pressure in the conduits 166 and 169 which would read 10,000 lbs. on the guage 180 or an additional 4000 lbs. over that previously introduced. This will increase the pressure above the diaphram of the differential pressure switch with the pressure below the diaphram still being at the level set by the pressure transducer 130 reading the amount of liquid presently in the container 100. Thus, the diaphram will again be deflected downwardly causing the switches 80*a* to both operate and drive the auguer 115 introducing the dry material into the container and the agitator. The selector valve 168, after adjustment of the pressure regulating valve 165, will be shifted back to the pressure transducer line 142 to read the change in weight of the material in the container as the dry material is introduced. This will be reflected by a change in pressure below the diaphram 15 as weight is increased into the container. During this period of time, the agitator 120 will be operated through its motor 125 performing a mixing operation. As the desired quantity is reached, that is the additional 4000 lbs., the pressure below the diaphram 15 of the pressure differential switch will approach the reference pressure above the diaphram. The first or lowest of the controllers 80*a* will first be operated providing a shut down or dribble action causing the change in speed of operation of the motor 115 by opening one set of windings, and also shutting the agitator motor. As the desired quantity is approached and reached, the pressure differential in the differential pressure switch approaches and reaches differential pressure at which point the second of the lower switch 80*a* opens deenergizing the auger motor 115. With the batch thoroughly mixed in the correct proportions, the discharge of the material from the container will be undertaken. The switches above the reference point will now control the motor or actuator 160 operating the valve 155 on the discharge side of the container. Assuming that the mixed material is to be withdrawn in 2000 lbs. increment, the pressure regulating valve 165 will be coupled to the meter through the selector valve 168 and adjusted in pressure to read a desired level of 8000 lbs. or a 2000 lbs. change as a desired quantity to be removed from the container. With this pressure level adjustment, the differential pressure in the switch 10 will now be such that the pressure below the diaphram 15 reading a full container from the pressure transducer 130 will be larger than the fixed pressure above the diaphram, thereby moving the magnet 60 up into proximity of the pair of switches 80*b*. As the magnets so move, these switches close, operating the two stage actuator 160 to open the valve 155. The material will now be withdrawn from the container and the quantity of liquid being withdrawn will be included on the guage 180 by shifting the selector switch 168 back to the pressure transducer line to follow the change in variable pressure below the diaphram in the differential pressure switch. As the differential pressure switch approaches a zero differential pressure reflecting the withdrawal of a desired quantity from a container, the uppermost of the switches 80*b* is operated to open, shifting the actuator 160 to throttle the valve 155 reducing the flow therefrom in a dribble type action to approach the desired quantity level of withdrawal from the container. Flow from the container will then be at a reduced level until the desired quantity is removed, at which point the pressure transducer will reflect the pressure in the differential pressure switch equal to the set or fixed pressure set by the regulator 165 at which point both of the switches 80*b* will be open and the actuator 160 operated to close the discharge valve 155. This process can be repeated to remove discreet quantities of liquid from the container until the container is emptied and ready to be filled with a new batch.

Thus, the improved differential pressure switch provides a means for accurately responding to a differential pressure near zero with a minimum amount of friction to make the device have an effective narrow range of operation and be extremely sensitive in this range. The shape of the recess or chambers and the elasticity of the diaphram make the device relatively insensitive to pressure differentials outside of the operating range even though they are of greater magnitude. The improved differential pressure switch utilizes no springs, links, levers, bearings, or shaft seals and has a wide working range with an extremely wide latitude in setting of the point of operation. The method of actuating either electrical or fluidic sensors in a frictionless manner through the use of the magnet and the wall of a tube eliminates the necessity of mechanical motion transmission making the device extremely accurate and applicable in a wide variety of applications one of which is indicated above.

Therefore, in considering this invention it should be remembered that the present disclosure is illustrative only and the scope of the invention should be determined by the appended claims.

What I claim is:

1. A differential pressure switch comprising, an actuator body, an internal recess in said body, a diaphram positioned in said body and stretched across said internal recess to define two symmetrical chambers conically shaped in form when said diaphram is in a neutral position, a pair of ports extending through said body and communicating respectively with said chambers, said diaphram being made of an elastic material such as to stretch and be displaced to opposite ends of said recesses with variation in differential pressure applied to said chambers through said ports, a shaft having a flat head at one end positioned in one of said chambers and extending through an opening in said body with the flat head bearing against said diaphram, a tube member surrounding said shaft and sealed to said body around said opening, a permanent magnet mounted on the end of the shaft within the tube and opposite the flat head, ajustable mounting means mounted on the body and positioned adjacent said tube, and magnetically operated controller means mounted in said mounting means and operable through magnetic flux from said magnet on said shaft with movement of the diaphram from said neutral position.

2. The differential pressure switch of claim 1 in which the magnetically operated controller means are a pair of reed switch means mounted on said adjustable mounting means at different heights above the body and operable with movement of the magnet within the tube upon displacement of the diaphram to raise or lower the magnet and selectively operate one or the other of the switch means.

3. The differential pressure switch of claim 1 in which fluid under pressure is applied through one pair of ports to the respective chambers, one port having a fixed pressure applied thereto and the other having a variable pressure applied thereto.

4. The differential pressure switch of claim 1 in which the actuator body is formed of a pair of parts with a diaphram clamped between said parts and separating the recess in said pair of chambers.

5. The differential pressure switch of claim 4 in which the body parts have cooperating shoulder portions positioned adjacent said recess and in which the diaphram is clamped between said shoulder portion and on either side of the same to clamp the diaphram in two directions.

6. The differential pressure switch of claim 1 in which the magnetically operable switch means are a pair of reed switches having electrodes of magnetic material.

7. The differential pressure switch of claim 6 in which the tube member is made of a non-magnetic material such that flux from said magnet within the tube will attract the electrode members when positioned adjacent thereto.

8. The differential pressure switch of claim 7 in which the adjustable mounting means includes in part flanges of non-magnetic material holding the reed switches.

9. The differential pressure switch of claim 8 and including a cover member positioned over said tube and said adjustable mounting means with the reed switches thereon and with an aperture therein to provide for access to the electrodes of the reed switches.

10. The differential pressure switch of claim 1 in which the recess in said body defining with the diaphram the pair of conically shaped chambers slopes in a direction away from the reference position of the diaphram to increase and accentuate nonlinearity of the diaphram motion with the differential pressure change.

11. The differential pressure switch of claim 1 in which the magnetically operated controller means are four in number and the adjustable mounting means are four in number positioned in diametrically opposed pairs around said tube and mounting said switches.

12. The differential pressure switch of claim 1 in which the adjustable mounting means including at least a pair of screw shaft members having a threaded exterior and with pairs of nuts thereon positioning mounting flanges in spaced relationship on the shaft to mount the magnetically operated switch means therebetween.

13. The differential pressure switch of claim 11 in which two of the four controllers are mounted on said adjustable mounting means at a level to be operated sequentially with movement of the diaphram in one direction from the neutral position and with the remaining two controllers being mounted so as to be operated in sequence with movement of the diaphram in the opposite direction of the neutral position.

14. A differential pressure switch comprising, an actuator body, an internal recess in said body, a diaphram positioned in said body and stretched across said internal recess to define two symmetrical chambers when said diaphram is in a neutral position, a pair of ports extending through said body and communicating respectively with said chambers, said diaphram being made of an elastic material such as to stretch and be displaced to opposite ends of said recesses with variation in differential pressure applied to said chambers through said ports, a shaft having a head at one end positioned in one of said chambers and extending through an opening in said body with the head bearing against said diaphram, a tube member surrounding said shaft and sealed to said body around said opening, a permanent magnet mounted on the end of the shaft within the tube and opposite the head, adjustable mounting means mounted on the body and positioned adjacent said tube, and magnetically operated controller means mounted in said mounting means and operable through magnetic flux from said magnet on said shaft with movement of the diaphram from said neutral position.

* * * * *